US006502950B2

(12) United States Patent
Signer

(10) Patent No.: US 6,502,950 B2
(45) Date of Patent: Jan. 7, 2003

(54) INSTALLATION FOR ILLUMINATING ROOMS

(75) Inventor: Rudolf Signer, Abtwil (CH)

(73) Assignee: Heliobus AG, St. Gallen (CH)

( * ) Notice: Subject to any disclaimer, the term of this patent is extended or adjusted under 35 U.S.C. 154(b) by 0 days.

(21) Appl. No.: 09/826,925

(22) Filed: Apr. 6, 2001

(65) Prior Publication Data

US 2001/0028563 A1 Oct. 11, 2001

(30) Foreign Application Priority Data

Apr. 11, 2000 (CH) ..... 0729/00

(51) Int. Cl.[7] ..... F21V 7/04; F21V 8/00

(52) U.S. Cl. ..... 362/147; 362/373; 362/580; 362/576; 362/301; 362/349; 362/153; 52/DIG. 17; 52/200

(58) Field of Search ..... 362/147, 145, 362/153, 153.1, 267, 310, 559, 576, 560, 347, 349, 151, 152, 580, 294, 373, 297, 298, 302, 346; 52/DIG. 17, 200, 201

(56) References Cited

U.S. PATENT DOCUMENTS 4,539,625 A * 9/1985 Bornstein et al. ..... 362/145
6,059,438 A * 5/2000 Smith et al. ..... 362/583
6,178,707 B1 * 6/2001 Bengtson ..... 52/200

* cited by examiner

*Primary Examiner*—Thomas M. Sember
(74) *Attorney, Agent, or Firm*—Browdy and Neimark

(57) ABSTRACT

The installation comprises a housing (3) which is assigned to one of the walls (5) of the room (42) which is to be lit. A light-guiding arrangement is provided in the housing (3) and is designed such that it can guide light from the outer end part (38) of the housing (3), through an opening (8) in the wall (5) of the room (42) which is to be lit, into said room. The outer mouth opening of the light-guiding arrangement is covered over with the aid of a sheet-like arrangement (25) which is designed such that it allows light to enter into the light-guiding arrangement. An arrangement for ventilating the room which is to be lit is also provided. One of the mouth openings (36) of said ventilating arrangement is located in the covering arrangement (25). A window (1) is arranged in the opening (8) of the room (42) which is to be lit, said window being designed such that it allows not only the incidence of light but also ventilation of the interior (42).

17 Claims, 7 Drawing Sheets

INSTALLATION FOR ILLUMINATING ROOMS

BACKGROUND OF THE INVENTION

1. Technical Field of the Invention

The present invention relates to an installation for illuminating rooms, in particular in buildings.

2. Prior Art

Many houses have cellars or basement rooms in which the windows are located wholly or partially beneath the level of the surrounding terrain. Openings located wholly beneath this level in particular only receive air and some daylight through shafts which are intended specifically therefor and are driven into the ground in front of the opening-containing wall. Such opening-containing rooms normally require constant artificial lighting in order that they can be utilized expediently. The utilization of these rooms is vastly restricted by the additional energy consumption, but also by the psychological effect of the lack of daylight in comparison with ground-level rooms.

OBJECT OF THE INVENTION

One of the objects of the present invention is to eliminate the abovementioned disadvantages, and also further disadvantages, of the prior art.

BRIEF DESCRIPTION OF THE DRAWINGS

Embodiments of the present installation are explained in more detail hereinbelow with reference to the attached drawings, in which.

DETAILED DESCRIPTION OF THE DRAWINGS

Figure 1:
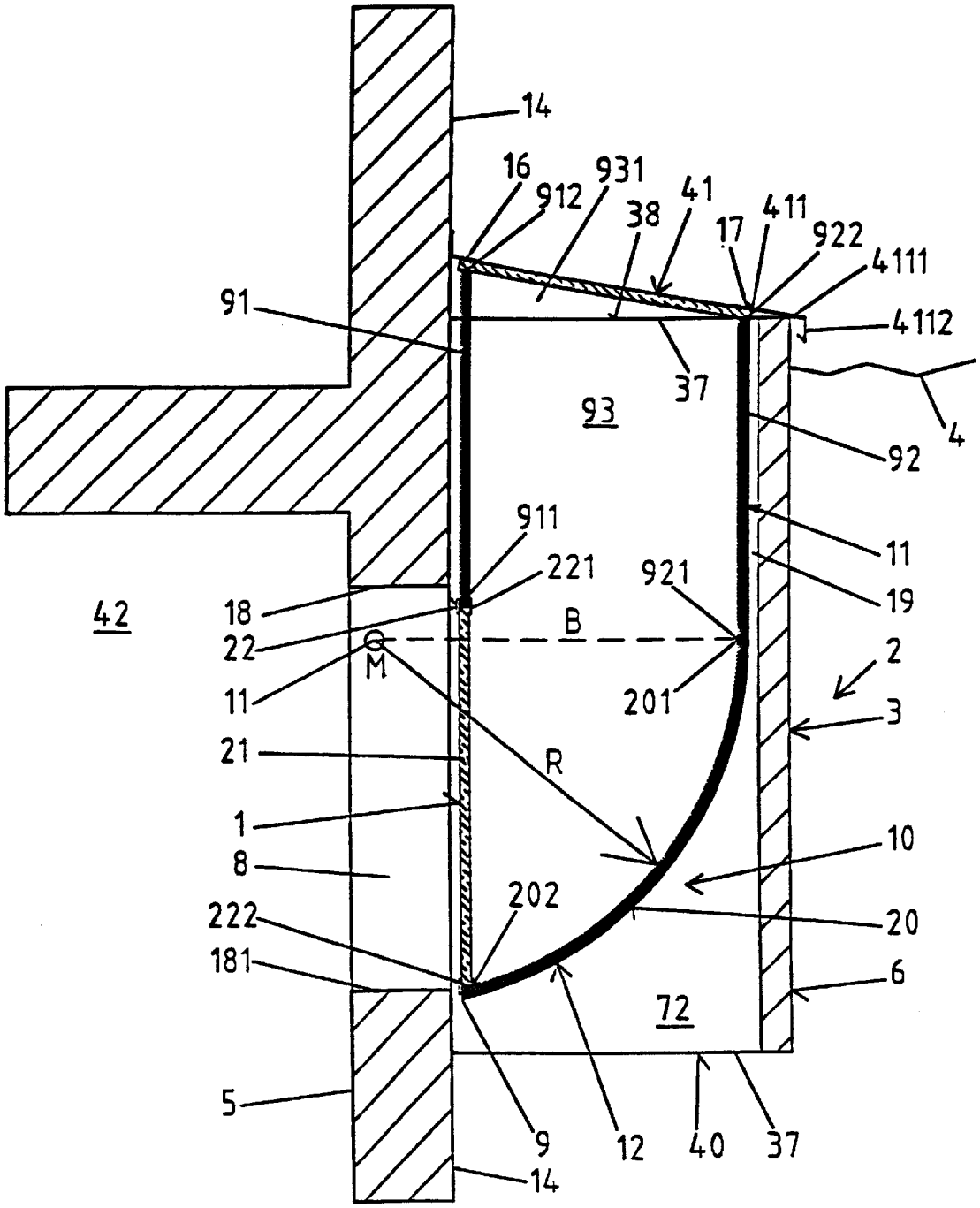
FIG. 1 shows, in a vertical section, a first embodiment of the present installation.

FIG. 1 shows a first embodiment of the present installation which may serve, in particular, for illuminating basement rooms, for example in building structures. Illustrated schematically in FIG. 1 is part of a wall 5, which may constitute one of the constituent parts of a building structure, for example of a house. This part of a wall 5 is located beneath the level of the ground 4. An opening 8 is made in that part of the building-structure wall 5 which is illustrated, it being possible for a cellar window normally to be inserted in said opening. The building opening 8 may be quadrilateral, round, oval or the like. In the case illustrated, the wall opening 8 is rectangular and is likewise located beneath the level of the ground 4. In the case illustrated, the longer sides of the rectangle run horizontally. A room 42 which is to be lit is located behind the cutout 8, i.e. on the inside of the building wall 5.

A shaft 2 extends between the top level of the ground 4 and the region of the building opening 8. The present installation comprises a housing 3 which is located in said shaft 2 and constitutes the outer boundary of the shaft 2 in relation to the ground 4. The housing 3 may be made of a conventional construction material, e.g. of concrete. Such a housing 3 may also be present in the form of a prefabricated element which is assigned to the outer surface 14 of the house wall 5 such that the wall opening 8 is located in the region of said housing 3.

In the case illustrated in FIG. 1, the basic body of the housing 3 has a U-shaped cross section, with the result that the basic body has two lateral walls 71 and 72 and a transverse wall 6 connecting one edge of each of these side walls 71 and 72. The longitudinal axis of such a housing 3 runs essentially vertically, with the result that the walls 6, 71 and 72 of the housing 3 also run vertically. Since the shaft 2 in the installation illustrated in FIG. 1 is comparatively long, the length of the housing 3 is greater than the width of the same. Consequently, the abovementioned vertically running edges of the side walls 71 and 72 of the housing 3, which are connected to one another by the transverse wall 6 of the housing 3, are longer than the horizontally running edges 37 of the side walls 71 and 72. In FIG. 1, in which the present installation is illustrated in a vertical section, it is possible to see only the rear side wall 72 of the housing 3.

The U-shaped housing 3 has end regions 38 and 40 which, inter alia, comprise the horizontally running edges 37 of the housing side walls 71 and 72. One of these end regions 38 is located at the top approximately level with the ground 4; said end region 38 runs more or less horizontally and is open. The opposite end region 40 of the housing 3 is located deep in the ground 4, to be precise at least in the region of the bottom edge 181 of the building opening 8. Said bottom end side 40 of the housing 3 is expediently open in order to make it possible for the water which may possibly have penetrated into the housing 3 to be able to seep into the ground 4. It is also possible, however, for said bottom end side 40 of the housing 3 to be closed, to be precise, for example, with the aid of a bottom end wall 13 (FIG. 6) which is integral with the rest of the walls 6, 71 and 72 of the housing 3. At the termination of the bottom end opening 40 in the housing 3, however, it is also possible to use a cover, which may be of a type which is known per se. Such a cover allows water to seep into the ground 4 from the housing 3. At the same time, it is also possible for this cover, with a corresponding visually pleasing design of the same, to serve as a screen in order that one cannot see the ground 4 through the opening 8 in the building wall 5.

Such a housing 3 is assigned to the outer surface 14 of the building wall 5 in a manner known per se via the free and vertically running edges 9 of the sides walls 71 and 72 of the housing. In some circumstances, even just the pressure of the ground 4 on the outside of the vertically running transverse wall 6 of the housing 3 is sufficient in order to retain said housing 3 in a desired position in relation to the building opening 8. The walls 6, 71 and 72 of the housing 3 define three walls of the shaft 2. The fourth wall of the shaft 2 is formed by the abovementioned section 14 of the outside of the building wall 5, said section being located essentially above the wall opening 8.

A light-guiding channel 10 is located in the housing 3. One end of said light channel 10 is located in the region of the level of the ground 4, with the result that light can pass into the channel 10 through said end. The other end of the light channel 10 is assigned to the building opening 8. Consequently, the light channel 10 extends between the top level of the ground 4 and the underground wall opening 8. The light channel 10 has an outer section 11 and an inner section 12. The outer section 11 of the light channel 10 serves, in particular, for guiding the captured light over the difference in height between the ground level 4 and the region of the wall opening 8. The inner section 12 of the light channel 10 serves, in particular, for deflecting the supplied light into the wall opening 8 and thus also for supplying light into the interior of the room 42 which is to be lit.

In the case illustrated, the cross section of the outer section 11 of the light channel 10 is rectangular. This outer channel section 11 has at least two mutually opposite sheet-like reflector elements 91 and 92 which run parallel to the building wall 5 and to the transverse wall 6 of the housing 3. These reflector elements 91 and 92 may be designed as reflector panels 91, 92 which run parallel to one another. One of these reflector panels 91 is assigned to the outer surface 14 of the building wall 5 above the building opening 8, and it is fastened here in a manner known per se. The opposite or second reflector plate 92 is assigned to the inside of the transverse wall 6 of the housing 3, and it is fastened here in a manner known per se.

In order to achieve a higher efficiency in the guidance of light from the start of the light channel 10 to the building opening 8, two further, lateral reflector elements 93 and 94 (FIG. 4) are arranged in the light channel 10. These reflector elements 93 and 94 may also be designed as reflector panels which run parallel to one another. The panels 93 and 94 of this reflector pair are located perpendicularly to the panels 91 and 92 of the first reflector pair, the borders of in each case one of these further panels 93 and 94 being connected to the borders of the panels 91 and 92 of the first reflector pair. In each case one of these further reflector panels 93 and 94 is located in the immediate vicinity of the inside of one of the side walls 71 and 72, respectively, of the housing 3. The two further or lateral reflector elements 93 and 94 have at least one section which is arranged in the top section 11 of the light channel 10. Consequently, such a top section 11 of the level channel 10 comprises a total of four reflecting elements 91 to 94, which constitute the lateral surface of a cuboid.

The reflecting panels 91 and 92, which are arranged parallel to the transverse wall 6 of the housing 3, are located in the top section of the shaft 2 or of the housing 3 and extend down from here approximately as far as the center of the shaft 2, but at most as far as the top edge 18 of the cutout 8 in the building wall 5. The reflecting panels 93 and 94, which are arranged perpendicularly to the transverse wall 6 of the housing 3, begin in the top section of the shaft 2 or the housing 3 and extend down from here approximately into the bottom region of the shaft 2 or of the housing 3, with the result that they extend more or less over the entire height of the housing 3.

The respective reflector elements 91 to 94 may have a non-reflective panel-like basic body. That surface of the basic body of such elements 91 to 94 which is directed toward the interior of the channel 10 is mirror-coated in order to reflect the light which is incident in the top channel end 38 from above, and thus to direct it further through the light channel 10. It is also possible, however, for the respective reflector element 91 to 94 to be designed as a mirror.

The top and, in fact, open end region 38 of the housing 3 is covered over with the aid of a cover 41. Said cover 41 is produced as a panel from a translucent or even transparent material. Such material may be one of the materials of this type which are known per se, and may preferably be glass or plexiglass. In the case of a glass, for reasons of stability, it is preferably possible to use bulletproof glass. One border part 16 of the cover 41 adjoins the outside 14 of the building wall 5. The opposite border part 17 of the cover 41 is located in a region of the transverse wall 6 of the housing 3.

The height or the vertically running length of the first parallel reflector panel 91, which is located in the immediate vicinity of the building wall 5, is set such that the bottom edge 911 of said panel 91 is located level with the top edge 18 of the building opening 8. The top edge 912 of said reflector plate 91 is located above the top edges 37 of the side walls 71 and 72 of the housing 3. Although the top edge 922 of the opposite parallel reflector plate 92 is likewise located above the top edge 37 of the side walls 71 and 72 of the housing 3, said top panel edge 922 is located beneath said top edge 912 of the first parallel reflector panel 91.

The cover 41 rests on the top edges 912 and 922 of the parallel reflector panels 91 and 92. The border part 16 of the cover 41, said border part being assigned to the building wall 5, rests on the top edge 912 of the reflector panel 91, which is assigned to the building wall 5. The border part 17 of the cover 41, said border part being remote from the building wall 5, rests on the top edge 922 of the reflector panel 92, which is remote from the building wall 5. This results in an inclined position of the cover 41, which is illustrated in FIG. 1.

The vertical or lateral reflectors 93 and 94 of the light-guiding channel 10 may project beyond the top edges 37 of the side walls 71 and 72 of the housing 3. The respective upwardly extending section 931 of the side reflectors 93 and 94 is terminated by an oblique running, top edge. The inclination of this edge corresponds to the inclination of the covering panel 41, with the result that the covering panel 41 also rests on said oblique edges of the side reflectors 93 and 94.

The second border part 17 of the cover 41, said border part being remote from the building 5, terminates, in the case of the installation according to FIG. 1, in the region of the outer reflector panel 92, i.e. still in front of the transverse wall 6 and thus above the cavity of the housing 3. The outer edge 17 of the cover 41 is located just behind said outer reflector panel 92. A gap 19 is formed between said reflector panel 92 and the transverse wall 6 of the housing 3. In order to prevent rainwater from passing into said gap 19, and thus also into the interior of the housing 3, that border of the cover 41 which is remote from the wall 5 is provided with a canopy 411. Said canopy 411 constitutes, in principle, an extension of the cover 41 behind the transverse wall 6 of the housing 3. Said canopy 411 may be designed, for example, as a sheet-metal strip which extends along the border part 17 of the cover 41 and of which the longer edges run more or less parallel to the top edge 922 of the second reflector panel 92. Said material strip 411 is bent in its longitudinal direction, with the result that it has two legs 4111 and 4112. The free border part of the first-mentioned leg 4111 is assigned to the border 17 of the cover 41 and is fastened here. Said leg 4111 is of such a width that the second and downwardly directed strip leg 4112 is located just behind the outside of the transverse wall 6 of the housing. Said second strip leg 4112 is designed to be of such a width and/or height that its free bottom edge is located beneath the top edge of the transverse wall 6.

The inner section 12 of the light channel 10 adjoins the bottom end of the outer section 11 of the light channel 10, to be precise such that the light passing through the outer section 11 of the light channel 10 to the top end of the inner section 12 of the light channel 10 is reflected into the wall opening 8 by said inner section 12 of the light channel 10. The inner section 12 of the light channel 10 comprises a reflector element 20 which is designed as a bent and light-reflecting panel. Said reflector element 20 is located opposite the wall opening 8 and constitutes a section of the lateral surface of the cylinder with a horizontally running longitudinal axis. The cylinder has a radius R which extends from a center point M through which the longitudinal axis of the cylinder also passes. Said center point M is located in the interior of the wall opening 8 and, moreover, in a plane B which runs horizontally. The cylinder section 20 has rectilinear edges 201 and 202, which likewise run horizontally and, at the same time, parallel to the longitudinal axis of the cylinder.

The radius R is selected such that the first or top edge 201 of said concave reflector 20 is assigned in a flush manner to the bottom edge 921 of the second planar reflector 92 in the outer section 11 of the light channel 10. These edges 201 and 921 are likewise located in said horizontal plane B. The second edge 202 of the concave reflector 20 is assigned, with said radius R, to the bottom edge 181 of the opening 8 in the wall 5. In this case, said bottom reflector edge 202 may butt against the outside 14 of the building wall 5 or be spaced apart from said outside or outer surface 14. The concavely curved inside of the hollow reflector 20 is likewise mirror-coated. This makes it possible for the light which is incident vertically through the outer section 11 of the light channel 10 to be reflected into the wall opening 8.

In order to increase the light efficiency in the case of the reflection of the light into the opening 8, the side reflectors 93 and 94 of the outer section 11 of the light channel 10 are extended into the region of the inner section 12 of the light channel 10, with the result that they extend as far as the bottom edge 181 of the wall opening 8. In this case, that bottom corner part of the respective side reflector 93 and 94 which is located in the immediate vicinity of the transverse wall 6 of the housing 3 is rounded in accordance with the profile of the hollow reflector 20.

The wall opening 8 can be closed, or closable, at least in part by a window 1. In the case illustrated, the window 1 is located in front of the cutout 8, i.e. on the outside 14 of the side wall 5 of the building. In the case illustrated in FIG. 1, said window 1 comprises just one transparent panel 21, for example made of glass, which is located more or less in the same plane as the first parallel reflector 91 of the outer section 11 of the light channel 10. In order to be secured on the wall opening 8, the glass panel 21 may be encased in a suitable manner, for example in a frame 22. Said frame 22 gives the glass panel 21 stability and, at the same time, bears some of the weight of the reflector panel 91. The bottom edge 911 of the last-mentioned reflector 91 rests, in the case illustrated, on the top side of the top, horizontal leg 221 of the window frame 22. The underside of the bottom, horizontal leg 222 of the frame 22 rests on the inside of the bottom edge 202 of the hollow reflector 20. The dimensions of the frame 22 and/or of the window panel 21 alone are selected, in the case of this installation, such that the window 1 covers over the entire surface area of the wall opening 8.

If all of the locations of the present installation where the individual panels of the light-directing channel 10 meet are designed as far as possible in a moisture-tight manner, which can be achieved with the aid of means which are known per se, then the situation where the reflecting surfaces of the panels are covered with moisture can be largely avoided.

Figure 3:
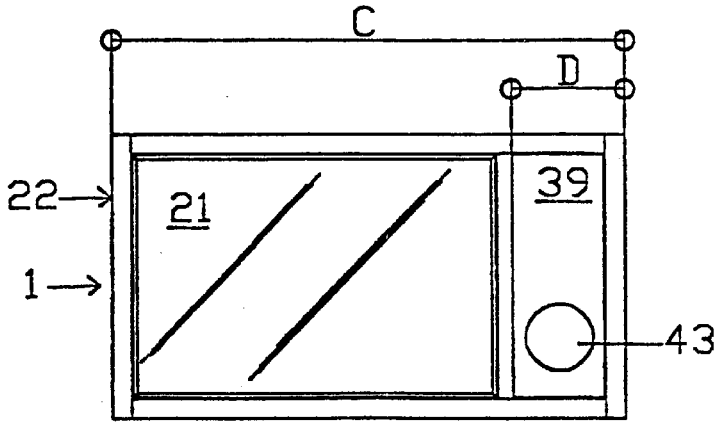
FIG. 3 shows a first front view of a first embodiment of the window of the installation from FIG. 2.
Figure 4:
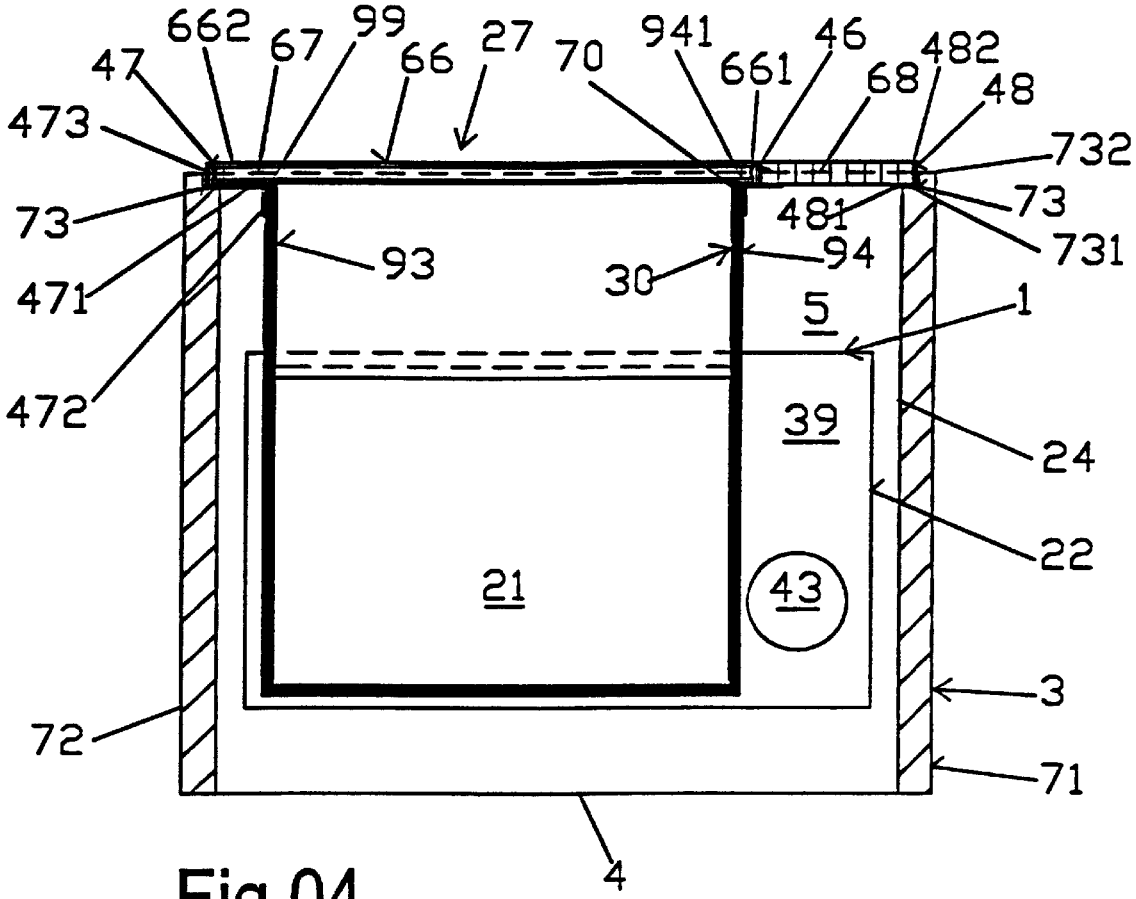
FIG. 4 shows, in a vertical section, a fourth embodiment of the installation according to FIG. 2.

That embodiment of the present installation which has just been described presupposes that it is sufficient if only light is introduced into the interior 42, because the glass panel 21 of the window 1 covers the entire surface area of the wall opening 8. There are also cases, however, in which it is desired to ventilate the room 42 as well as supply light into the room 42. Such an embodiment of the present installation is illustrated in FIGS. 2 to 4.

Figure 2:
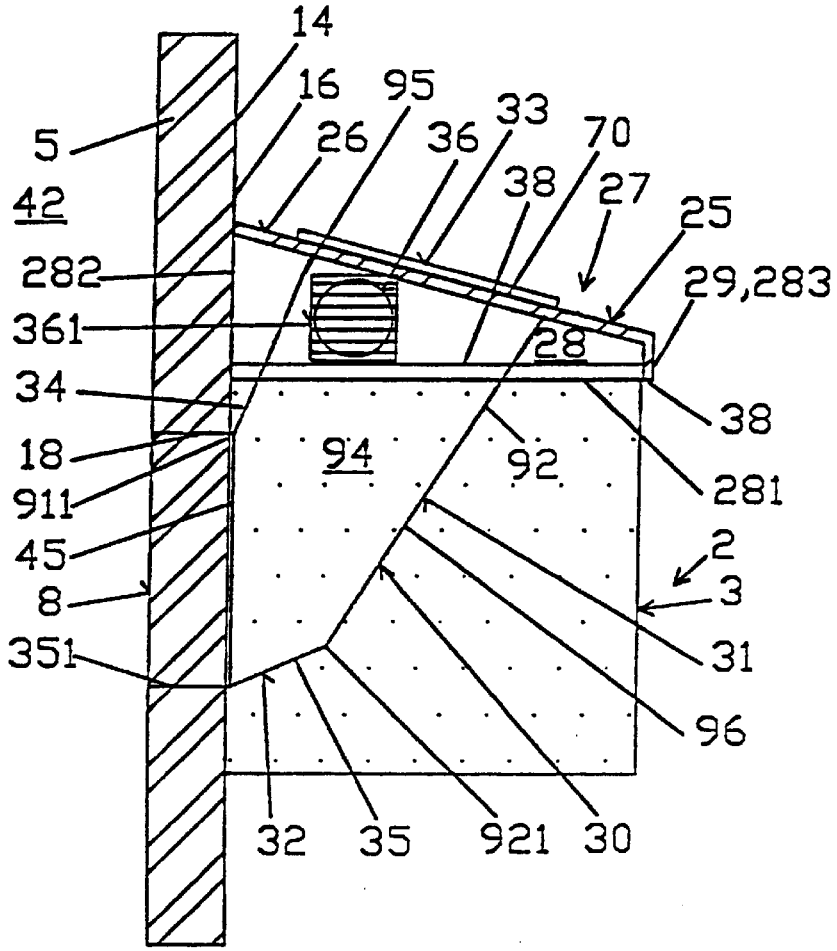
FIG. 2 shows a side view of a second embodiment of the present installation with a window.

That embodiment of the present installation which is illustrated in a side view in FIG. 2 has an attachment 25 which is, or can be, positioned on the top end part 38 of the housing 3. This attachment 25 has an essentially wedge-shaped basic body 26 which may be made of a material which need not be either transparent or translucent. Said basic body 26 may be made, for example, of sheet metal.

The basic attachment body 26 comprises a covering wall 27 which runs obliquely, to be precise approximately in the same way as the abovedescribed covering panel 41. In the region of the transverse wall 6 of the housing 3, an end wall 29 of the attachment 25 hangs down from the covering wall 27. Hanging down from the respective side edge of the covering wall 27 is in each case one side wall 28 of the attachment 25, of which only the front side wall 28 can be seen in FIG. 2. The respective side wall 28 of the attachment 25 is essentially wedge-shaped. In this case, the side wall 28 has a bottom edge 281 which runs more or less horizontally and is, or may be, assigned to the outside of the housing 3. Two end edges 282 and 283 of the attachment side wall 28 project up from the ends of said horizontal edge 281 of said attachment side wall 28.

The first of these vertical edges 282 is assigned to the building wall 5. The border part 16 of the covering wall 27, said border part being assigned to the building wall 5, may be fastened on the wall 5, with the result that the attachment 25 need not have any down-hanging wall here. The second of the vertical edges 283 of the attachment side wall 28 is located in the region of the transverse wall 6 of the housing 3, and said edge 283 is shorter than the first vertical edge 282. The already mentioned end wall 29 of the attachment 25 extends between the shorter vertical edges 283 of the attachment side walls 28. The horizontally directed length of the side walls 28 is greater than the depth of the housing 3 and/or than the width of the side walls 71 and 72 of the latter, with the result that the attachment 25 engages over the transverse wall 6 of the housing 3 and thus protects the interior of the housing 3 against the penetration of rainwater.

A light-directing channel 30 is located in the interior of the shaft 2. Said channel 30 likewise has an outer section 31 and an inner section 32. The outer end of the outer section 31 of the light-directing channel 30 passes through the covering wall 27 of the attachment 25, and this end or this light-inlet opening 70 of the channel 30 is terminated or covered over with the aid of an at least translucent panel 33. Light passes into the light-guiding channel 30 through said panel 33.

The outer section 31 of the present light-directing channel 30 may be of essentially the same design as the outer section 11 of the light-directing channel 10 according to FIG. 1, with the result that the present channel 30 may likewise have the reflectors 91, 92, etc. Since the wall opening 8 is located comparatively closely to the top end surface 38 of the housing 3, the parallel reflector elements 91 and 92 may run obliquely in relation to the vertical in the outer section 31 of the channel 30 illustrated in FIG. 2. At the same time, said reflectors 91 and 92 may be located perpendicularly to the translucent covering panel 33. In the case illustrated, the longitudinal edges 95 and 96 of said reflectors 91 and 92 converge somewhat in the direction of the wall opening 8, with the result that the angle between the respective longitudinal edge 95 or 96 of the respective reflector 91 and 92 and the covering panel 33 is other than 90 degrees.

A depression 34 which runs obliquely in relation to the vertical is formed in the building wall 5 above the top edge 18 of the wall opening 8. The width of said depression 34 corresponds to the width of the outer section 31 of the light-directing channel 30, this width being given by the transversely located reflectors 93 and 94 (FIG. 4) of said channel section 31. Consequently, an approximately central part of the outer section 31 of the light-directing channel 30, said central part comprising the first wall-parallel reflector 91, can pass through said oblique depression 34. The bottom edge 911 of the first wall-parallel reflector 91 is located here in the interior of the wall opening 8. This measure makes it possible to achieve a small spacing between the building wall 5 and the light-incident opening in the attachment 25, said opening being covered by the covering panel 33.

On account of the small spacing between the light-incidence opening in the attachment 25 and the wall opening 8, the second wall-parallel reflector 92 of the outer channel section 31 can penetrate deep into the shaft 2, with the result that a considerable part of the same is located opposite the wall opening 8. Since said second reflector 92 is positioned obliquely in relation to the vertical, that section of said second reflector 92 is located opposite the wall opening 8 reflects sufficient light directly into the interior 42.

The inner section 32 of the light-directing channel 30 adjoins, on the one hand, the inner end of the outer channel section 31 and, on the other hand, the wall opening 8. The inner section 32 does not require a separate reflector in the region of the bottom edge 911 of the wall-parallel reflector 91 because said bottom edge 911 is already located in the wall opening 8.

The inner section 32 of the light-directing channel 30 has a bottom reflector 35 which is designed as a planar reflecting panel. One of the edges of said reflector panel 35 is assigned in a flush manner to the bottom edge 921 of the second reflector 92 in the top channel section 31. The opposite edge 351 of said bottom reflector 35 is located in the wall opening 8. In order to assist the reflection of light, said bottom reflector 35 is inclined similarly to the second reflector 92, but at a somewhat greater angle to the vertical. The reflectors 93 and 94 (FIG. 4), which are located transversely to the wall 5, have extensions in their bottom region, the bottom edges of said extensions being assigned to the side edges of the bottom reflector 35, as a result of which the light channel 30 may be regarded as being closed laterally from the incident opening 70 to the outlet mouth opening 45 of the channel.

An opening 36 is made at least in one of the side walls 28 of the housing attachment 25, it being possible for air to flow through said opening between the interior of the housing 3 and the surroundings of the same. Said opening 36 is expediently covered over with the aid of a grating 361 which is known per se.

FIG. 3 shows a front view of a window 1 which can be used in conjunction with those embodiments of the present installation which are intended to allow the supply of air, as well as the supply of light, into the interior 42. FIG. 3 shows a first front view of said window 1, to be precise as seen from the interior 42 which is to be lit.

This window 1 can be inserted in the wall opening 8 and fastened in a manner known per se, and is subdivided into two regions. Located in the first of these regions is the already discussed glass panel 21, which occupies or covers over the entire surface area of said region and allows light to enter into the interior 42. The second region of the window 1 is designed for the through-passage of air. In the case illustrated, the surface area of said second window region is filled or covered over by a panel 39 which need not be either transparent or translucent. Said panel 39 is expediently made of a metal or of wood, and an opening 43 for the through-passage of air is made in said panel 39.

The width of the light channel 30, i.e. the spacing between the reflectors 93 and 94 (FIG. 4), which are located transversely to the wall 5, is smaller, in the case of this embodiment of the present installation, then the width C of the frame 22 of the window 1. The width of the light channel 30 corresponds to the width of the glass panel 21 in the window frame 22. The outlet end 45 (FIG. 2) of the inner section 32 of the light channel 30 is assigned, from the outside of the window 1, to that part of the window 1 which has the glass panel 21.

The width of the housing 3 of said installation is at least equal to the width C of the window frame 22. In the present case, the width of the housing 3 is taken to be somewhat greater (FIG. 4) than the width C of the window frame 22. This results in a secondary chamber 24 (FIG. 4) in the housing 3, said secondary chamber being located alongside the light channel 30 and extending more or less parallel to the same. The width of the secondary chamber 24 corresponds more or less to the width D of that part of the window frame 22 which is covered by the light-passage panel 39. The secondary chamber 24 in the housing 3 is connected in terms of flow, on the one hand, to the ambient air through the opening 36. (FIG. 2) in the housing attachment 25 and, on the other hand, to the interior 42 through the opening 43 (FIG. 3) in the through-passage panel 39 of the window 1. Consequently, air can flow through the secondary housing chamber 24 in both directions.

The covering wall 27 of the installation according to FIG. 4 comprises a transparent panel 66, e.g. a glass panel, which covers over the top or outer mouth opening 70 of the channel 30. This covering panel 66 runs more or less horizontally. That border part of the panel 66 which is depicted on the right in FIG. 4 rests on the top edge 941 of the right-hand side wall or of the right-hand reflector 94 of the channel 30, to be precise with the interposition of an elongate sealing element 46 which extends along said edge 941. Said elongate sealing element 46 has an essentially cross-shaped cross section, said element 46, at the same time, also performing a load-bearing function. One of the horizontal lugs of the cross 46 is located between the first or right-hand border 661 of the covering panel 66 and the top edge 941 of the reflector 94. The vertical legs of the cross 46 are fastened on the vertically running end surface of the border 661 of the covering panel 66 and on the outer, associated section of the border 941 of the reflector 94.

The vertical reflector 93 of the channel 30, said reflector being depicted on the left in FIG. 4, is spaced apart from the left-hand side wall 72 of the housing 3. The border part 67 of the covering panel 66, said border part being depicted on the left in FIG. 4, is designed to be of such a width that it bridges the spacing between the side wall 72 and the reflector 93. A rebate 73 is formed in the region of the inner top edge of the respective side wall 71 and 72 and in the transverse wall 6 of the housing 3, the longitudinal direction of said rebate coinciding with the longitudinal direction of the relevant edge. This rebate 73 opens up for it and in the direction of the interior of the housing 3, and has a horizontal flank 731 and a vertical flank 732. The left-hand edge part 662 of the covering panel 66 is located on the horizontal flank 731 of the rebate 73 in the left-hand side wall 72 of the housing 3. The covering panel 66 is borne in this way with the interposition of an elongate sealing element 47, which extends along the edge 931 of the first reflector 93, which is located perpendicularly to the wall 5.

Figure 7:
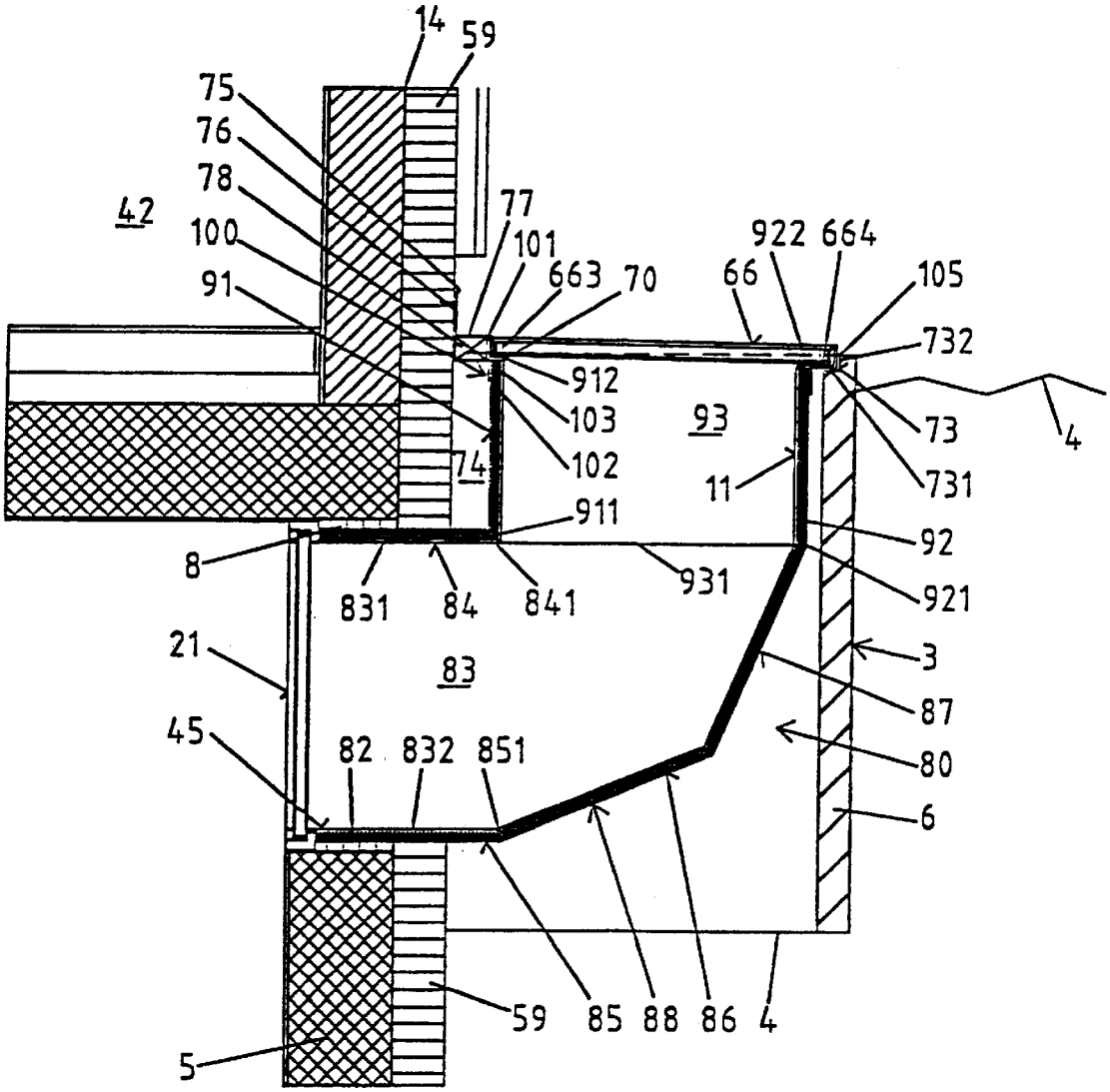
FIG. 7 shows, in a vertical section, a sixth embodiment of the present installation.

The sealing element 47 has an essentially L-shaped cross section. The free end region of the horizontal leg 471 of said L-element 47 is located between the top edge 931 of the reflector 93 and the underside of the covering panel 66. A strip-like stop 472 hangs down from the underside, at a spacing from said free end of said L-leg 471, it being possible for said stop to butt against the outer surface of the reflector 93. The region of the other, vertically running L-leg 473 of the sealing element 47 butts against the end surface of the second edge 662 of said border 67 of the covering panel 66. Said panel border 67 rests, via said region of the second L-leg 473, in the rebate 73 of said side wall 72 of the housing 3. Said rebate 73 is also formed in the top edge of the transverse wall 6 of the housing 3, with the result that the front border of the covering panel 66 is likewise located in said rebate 73 of the transverse wall 6 (FIG. 7).

A grating 68 is located in the top mouth opening of the secondary channel 24 in the housing 3 of the installation according to FIG. 4, the grating covering over said mouth opening, but nevertheless allowing air to flow through said mouth opening of the housing 3. That edge of the grating 68 which is depicted on the right in FIG. 4 is located in the rebate 73 of the right-hand side wall 71 of the housing 3, to be precise with the interposition of a further sealing element 48. The cross section of said third sealing element 48 is L-shaped, with the result that said sealing element 48 has a horizontal flank 481 and a vertical flank 482. Said third sealing element 48 is arranged in the rebate 73 such that its horizontal leg 481 is located on the horizontal leg 731 of the rebate 73, and that the vertical leg 482 of the sealing element 48 is located opposite the vertical leg 732 of the rebate 73. The opposite border of the grating 68 is supported on the second horizontal cross leg of the first sealing element 46. It goes without saying that the front border of the grating 68 rests, or may rest, in the rebate 73 of the transverse wall 6.

Figure 5:
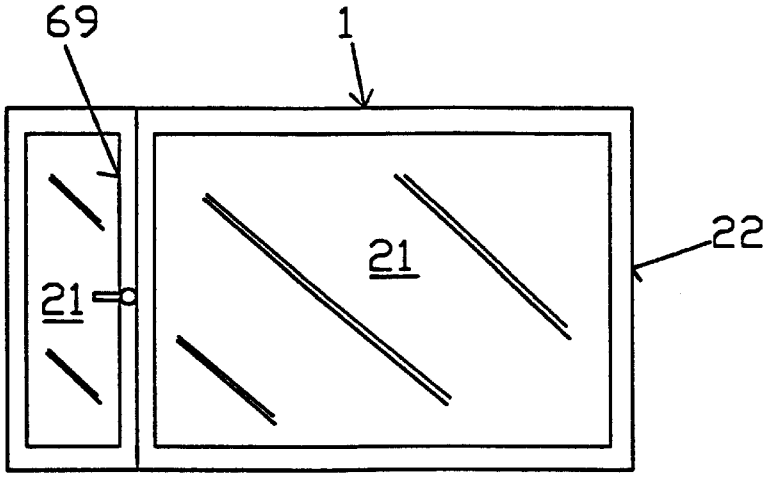
FIG. 5 shows a first front view of a second embodiment of the window of the arrangement from FIG. 2.

FIG. 5 shows a further embodiment of the window 1. That part of this window 1 which is intended for the through-passage of air has, instead of a fixedly installed panel, a window sash 69 which is mounted pivotably in the frame 22. Said window sash 69 may be designed as a bottom-hinged window or of a sash which can be pivoted in a horizontal plane. Using the window sash 69 provides the advantage of it being possible for the passage of air through the window 1 optionally to be interrupted, for example if it is cold. If the window sash 69 is fitted pivotably on the inside of the window 1, directed toward the interior of the room 42, then the window 1 may be equipped, at the same time, with a ventilator, which is described hereinbelow.

Figure 6:
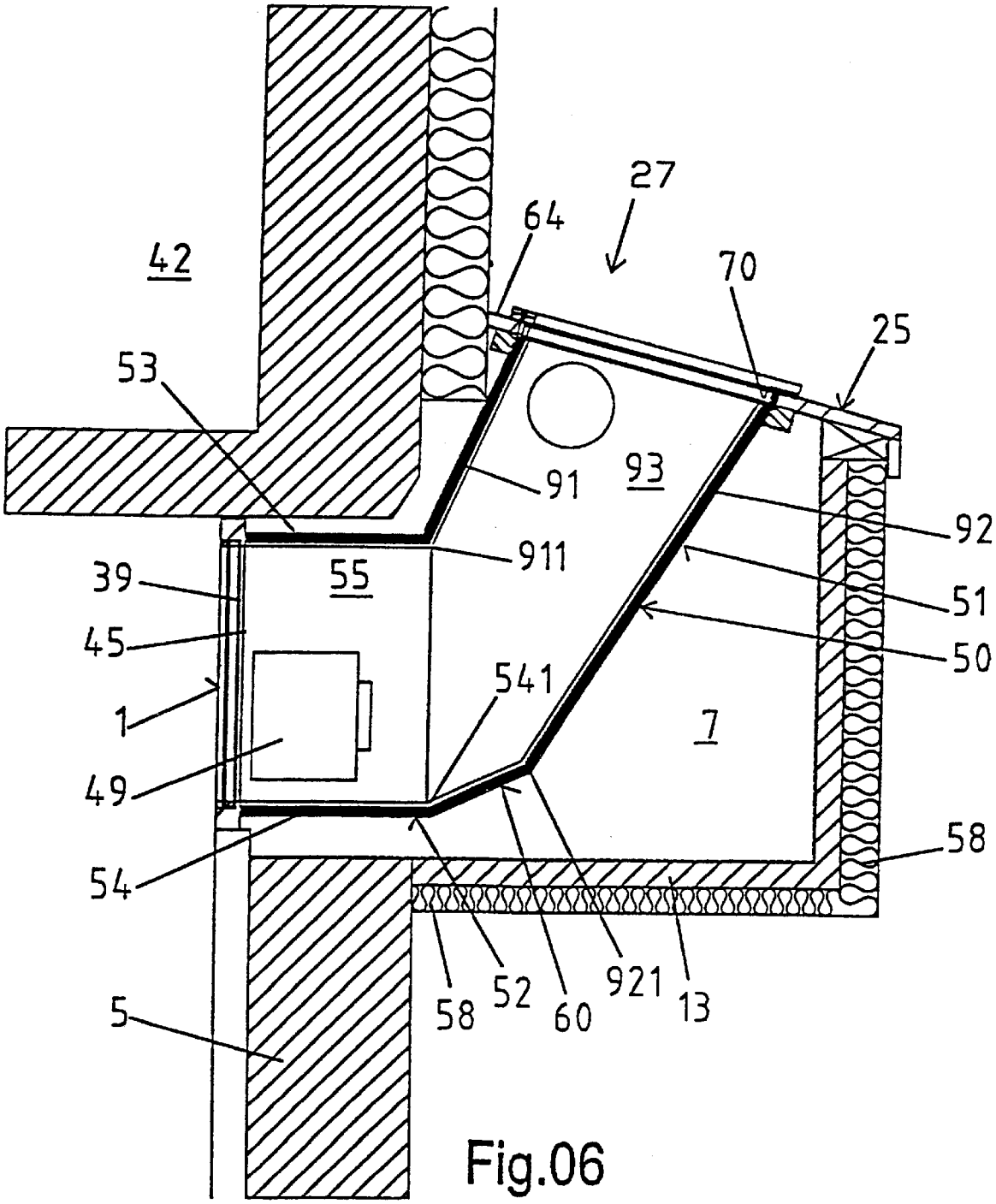
FIG. 6 shows, in a vertical section, a fifth embodiment of the present installation.

FIG. 6 shows, in a vertical section, a further possible embodiment of the present installation. The light-guiding channel 50 likewise has an outer section 51 and an inner section 52. The outer section 51 of said light-guiding channel 50 is of more or less the same design of the outer section 31 of the light-directing channel 30 in FIG. 2.

The inner section 52 of the channel 50 has a cross section which corresponds to the cross section of the window 1. In the present case, the inner section 52 of the channel 50 has a rectangular cross section, of which the longer sides run horizontally. Said inner channel section 52 is bounded by two horizontally arranged reflector elements 53 and 54 and by two vertically running reflector elements 55, of which in each case one extends between the end edges of the horizontal reflectors 53 and 54. The vertical reflectors 55 define the sides or side walls of a rectangle. Said second, inner channel section 52 is inserted in the wall opening 8 and the outlet part 45 of the same is assigned to the air-passage part 21 of the window 1 in the same way as has been described in conjunction with the light-directing channel 30 (FIG. 4). The reflectors 53 to 55 of said second channel section 52 and the wall-parallel reflectors 91 and 92 are in the form of quadrilateral panels. The contour of the reflectors 93 and 94, which are located perpendicularly to the wall 5, is such that said lateral reflectors 93 and 94 extend from the channel inlet mouth opening 70 to the start 541 of the second channel section 52.

A ventilator 49, which is assigned to the opening 43 in the air-passage panel 39, is provided. In the case illustrated, the ventilator 49 is assigned to the outside of the air-passage panel 39, and it is located in the bottom half of said panel 39. A ventilator 49 can assist the air flow between the interior 42 and the surroundings of the housing 3.

The longitudinal axis of the outer channel section 51 runs obliquely in relation to a vertical, to be precise approximately in the same way as has been described in conjunction with FIG. 2. The longitudinal axis of the inner channel section 52, however, runs perpendicularly in relation to the vertical. There would normally be a large gap between the bottom edge 921 of the second reflector 92, i.e. the reflector remote from the wall 5, in the top channel section 51 and the inner edge 541 of the bottom reflector 54. In order to avoid this gap, a bridging reflector 60, which extends between said edges of the reflectors 54 and 92, is provided. In the direction transverse thereto, said bridging reflector 60 extends between the lateral reflectors 93 and 94 of the channel 50.

That embodiment of the present installation which is illustrated in FIG. 6 likewise has the already described attachment 25, which is illustrated in a vertical section in FIG. 6. The housing 3 illustrated in FIG. 6 has a horizontally running base wall 13 which is assigned to the end side of the U-shaped basic body of the housing 3, said end side being located in the ground. The outside of the walls 6, 7 and 13 of the housing 3 is provided with a heat-insulating material 58. It is also possible for this material layer to comprise gypsum boards. The heat-insulating material 58 forms a comparatively thick layer on the outside of the vertically running walls 6 and 7 of the housing 3. In order to prevent rainwater from penetrating into the heat-insulating material 58 on the housing 3, the dimensions of the attachment 25 are selected such that the latter engages over, and thus covers over, the layer 58 of the insulating material.

The outside of the house wall 5 is likewise covered with a layer 59 made of a heat-insulating material or of gypsum boards. This insulating layer 59 increases the thickness of the masonrywork 5, it being possible, depending on the situation, for said insulating layer 59 to have different thicknesses. Consequently, the width of the border part 64 of the attachment 25, said border part being assigned to said insulating layer 59, has to be selected accordingly. A gap is present between the outer edge 271 of the border part 64, which has just been mentioned, of the attachment 25 and the outer surface of the insulating layer 59 on the wall 5. In order to achieve the situation where as little rainwater as possible passes through said gap to the wall opening 8, it is expedient for the width of the border 6 to be selected such that the free edge of said border 64 is pressed into the outside of the insulating layer 59.

That embodiment of the present installation which is depicted in FIG. 7 has a light channel or a light shaft 80 by means of which the light supplied to the interior 42 is deflected through 90 degrees. For this purpose, the channel 80 has two sections 11 and 82 arranged one behind the other. The first or outer section of the light channel 80 is of essentially the same design as the light channel 11 of the installation according to FIG. 1, the longitudinal axis of which likewise runs vertically. The top mouth opening 70 of said first or outer channel section 11 is covered over with the aid of the covering panel 66, which is described in conjunction with FIG. 4. The longitudinal axis of the second channel section 82, in contrast, runs horizontally, i.e. perpendicularly to the longitudinal axis of the first channel section 11. Part of the second or inner channel section 82 is located in the opening 8 of the wall 5. The light-outlet mouth opening 45 of the inner channel section 82 is more or less flush with the inner edge of the wall opening 8. It goes without saying, however, that it is also possible for the inner channel section 82 to be designed such that the section of the same projects into the interior 42.

The second or inner section 82 of the light channel 80 has mutually opposite and vertically running side walls 83, of which only the rear side wall 83 can be seen in FIG. 7. The respective side wall 83 has a top and horizontally running edge 831 which, in practice, extends from the outlet mouth opening 45 for the light as far as the bottom edge 921 of the second reflector 92 in the outer section 11 of the channel 80. Within the width of the outer channel section 11, said top horizontal edge 831 butts against the bottom horizontal edge 931 of the lateral reflector 93 located thereabove. It goes without saying that it is also possible for said side walls 83 of the inner channel section 82 to be reflective.

That section of the opposite, i.e. of the bottom, longitudinal edge 832 of the side wall 83 which is located in the wall opening 8 likewise runs horizontally. This horizontal section 832 is adjoined by a compound section of the bottom side-wall edge 832, this compound section being located beneath the outer section 11 of the light channel 80 and being determined by the design of the bottom wall, because the borders of the horizontal and vertical constituent parts of the channel sections 11 and 82 are connected to one another.

The second or inner section 82 of the light channel 80 also has mutually opposite and horizontally running walls 84 and 85. The majority of the top horizontal wall 84 is located in the wall opening 8. The inner edge 841 of said horizontal wall 84 butts against the bottom edge 911 of the first vertical wall 91 of the outer channel section 11. The bottom horizontal wall 85 of the first section 851 which is located opposite the top horizontal wall 84, and the inner edge 851 of which is located, in practice, beneath the abovementioned inner edge 911.

Sections 86 and 87, which are arranged one behind the other and adjoin the first section 85. These two further wall sections 86 and 87 may be of the same length. In contrast, the angular positions of said wall sections 86 and 87 in relation to a horizontal are different. The second wall section 86 encloses an angle of approximately 20 degrees with the horizontal, and a third wall section 87 encloses an angle of approximately 60 degrees with the horizontal. At least the inner surface of all the constituent parts of all the inner channel sections 82 is reflective. With the aid of the thus arranged wall sections 86 and 87, which are located opposite the outer channel section 11, it is possible for the light which entered into the interior of the channel 80 though the outer section 11 to be deflected through 90 degrees in order for it to be able to pass out of the inner channel section 80 into the interior 42 through the outlet mouth opening 45. The position of the inclined wall sections 86 and 87 also determined the profile of the bottom edge 832 of the side walls 83 of said bottom channel section 82.

That part of the inner channel section 82 which is inserted in the opening 8 projects, over a certain length, into the interior of the housing 3, with the result that the inner edge 841 of the top reflector 84 of the second channel section 82 and thus also the reflector 91 of the first channel section 11, said reflector being located in the immediate vicinity of the wall 5, are spaced apart from the outer surface 14 of the wall 5. The spacing is greater than the thickness of the wall insulation 59, with the result that a gap 74 is produced between the first wall-parallel reflector 91 and the wall insulation 59. The border 663 of the translucent covering panel 66, said border being directed toward the wall 5, rests on the top border 912 of the last-mentioned reflector 91. The opposite border 664 of the covering panel 66 is located on the top border of the opposite parallel reflector 92 and in the interior of the rebate 73 of the top border of the transverse wall 6.

In order to prevent rainwater from passing into the gap 74, a protective plate 75 is provided. This protective plate 75 has an approximately L-shaped cross section with the legs 76 and 77. The vertically running L-leg 76 is located as closely as possible to the outer surface of the wall insulation 59. The width of the horizontal leg 77 of said protective plate 75 is greater than the width of said gap 74. Consequently, said protective plate 75 may be arranged over the gap 74 such that the free border part of the horizontal L-leg 77 rests on the abutting border 663 of the covering panel 66. In order to ensure this position of the protective plate 75, a slat 78, for example a wooden slat, is arranged and fastened between the outside of the insulation 59 of the house wall 5 and the outside of the abutting reflector 91 and/or the border 663 of the covering panel 66 located here. The width of the slat 78 is more or less equal to the width of the gap 74. The top surface of said slat 78 is flush with the top surface of the covering panel 66, and the relevant part of the width of the horizontal L-leg 77 rests on this top surface of the slat 78.

Any possible penetration of water into the area located beneath the covering panel 66 is prevented by further sealing elements 47 and 100 which are assigned to the covering panel 66. The first-mentioned sealing element 47 is of essentially the same design as the sealing element 47 in FIG. 4. Said sealing element 47 is also assigned to the covering panel 66 in the same way. The sealing element 47 is located in the rebate 73 of the transverse wall 6 and of the side walls 71 and 72. The other sealing element 100 is arranged between the covering panel 66 and the reflector 91 in the vicinity of the wall, and it has an essentially T-shaped cross section. A crossbar part of said T-shaped cross section has two legs 101 and 102 which, in the case illustrated, run vertically. A stem part 103 of the T-shape 100 adjoins the crossbar part approximately in the center of the length of the crossbar part, i.e. between the legs 101 and 102. Said stem part 103 is located perpendicularly to said T-legs 101 and 102, between which its location of connection to the same is located.

The top T-leg 101 is located between the vertically running end surface of the border part 663 of the covering panel 66 located here and the spacer slat 78. The stem part 103 is located between the underside of said border part 663 and the top edge 912 of the reflector 91. The bottom leg 102 of the T-seal 100 is located on that side of the reflector 91 which is directed toward the wall 5. A suitable sealing compound 105 known per se may cover over, and render water-tight the joints between the top border of the covering panel 66 and that edge of the relevant sealing element 47 and 100 which is located here.

Figure 8:
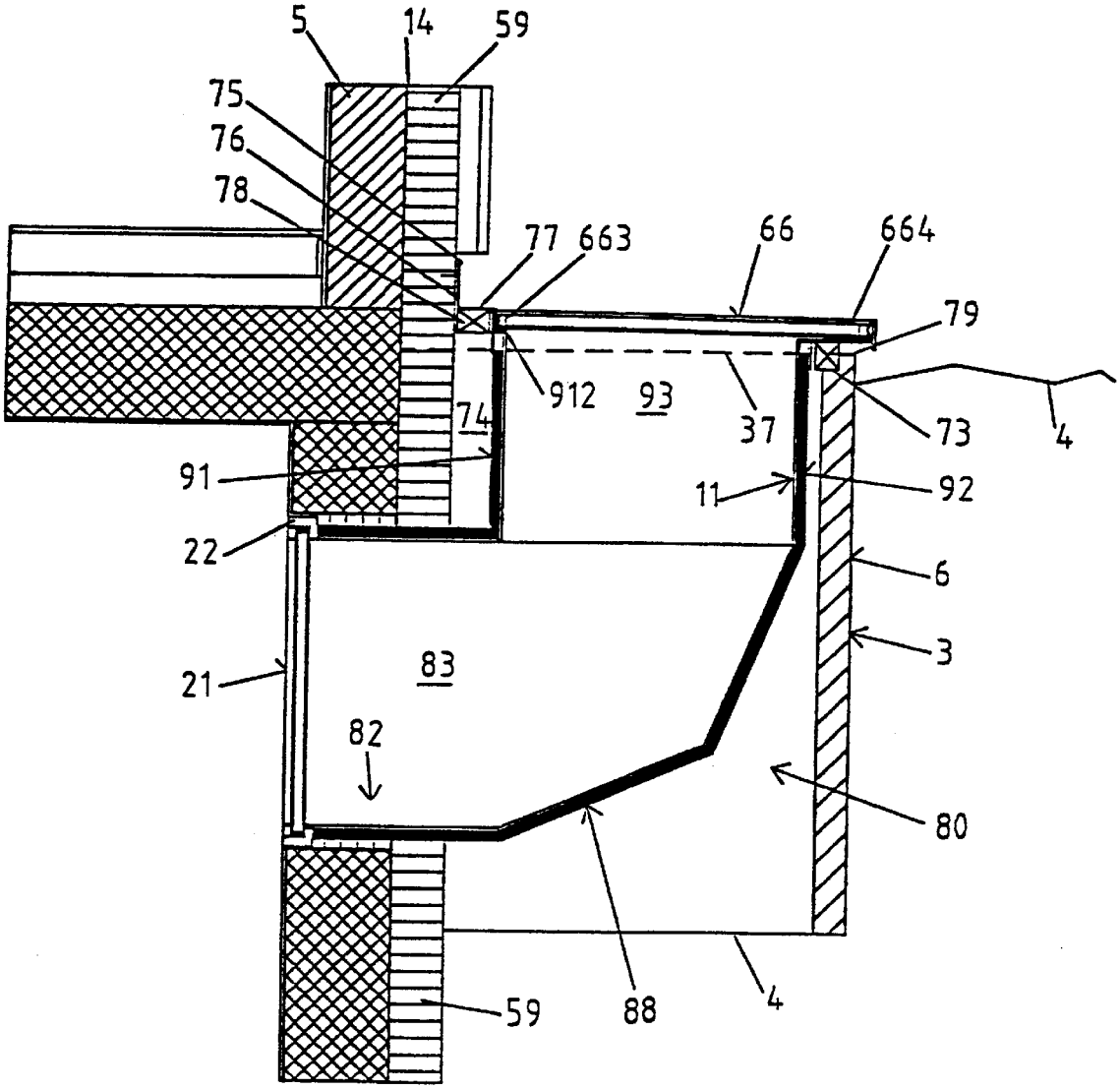
FIG. 8 shows, in a vertical section, a seventh embodiment of the present installation.

The insulation depicted in FIG. 8 is designed such that the covering panel 66 does not rest either on the top borders of the reflectors 91 and 92 of the light channel or on the top border of the housing 3. For this purpose, in each case one slat 79, for example made of wood, is arranged in the rebate 73 of the transverse wall 6 and the side walls 71 and 72, of which the height is greater than the depth of the rebate 73, with the result that the top part of said second slat 79 projects out of the rebate 73. The top border 912 of the first wall-parallel reflector 91, accordingly, is arranged at a higher level, with the result that the end surface of said border 912 is located at the same height as the surface of the second slat 79. The covering panel 66 rests on said border 912 and on the second slat 79, with the result that, as far as the housing 3 is concerned, the covering panel 66 is arranged at a higher level in the case of the insulation according to FIG. 8 than is the case in FIG. 7. This makes it possible to design the covering panel 66 to be of such a length and/or width that the end surface of the second border part 664 of the same, said border part being remote from the wall 5, is located behind the outer surface of the transverse wall 6 of the housing 3. In this way, the rainwater can be directed away by said covering panel 66 to a safe distance from the housing 3. The same also applies to those border parts of the covering panel 66 which run perpendicularly to said border part 664 and which overhang the side walls 71 and 72 of the housing 3 in such a case.

Figure 9:
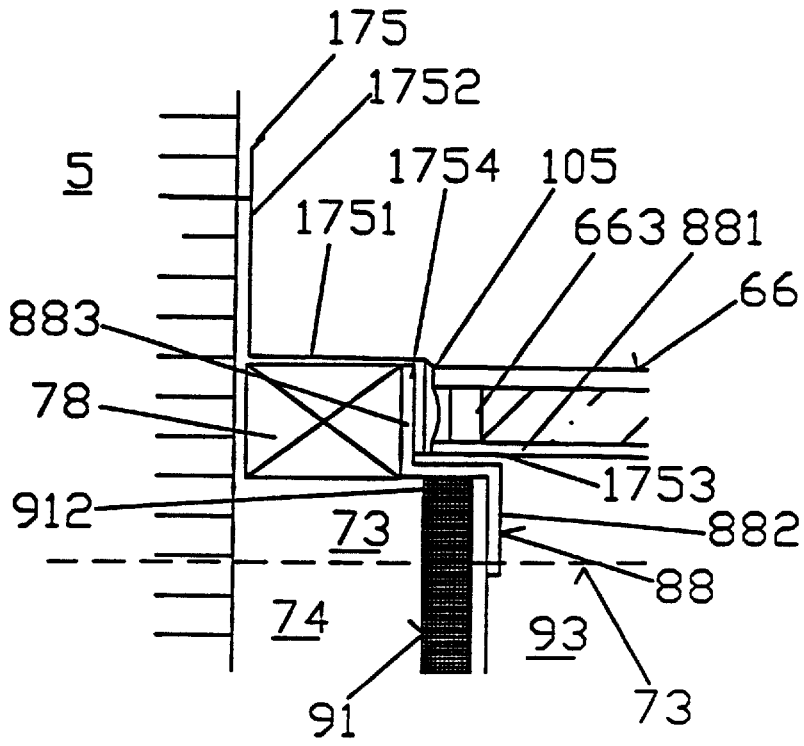
FIG. 9 shows, on an enlarged scale, a first detail from FIG. 8.
Figure 10:
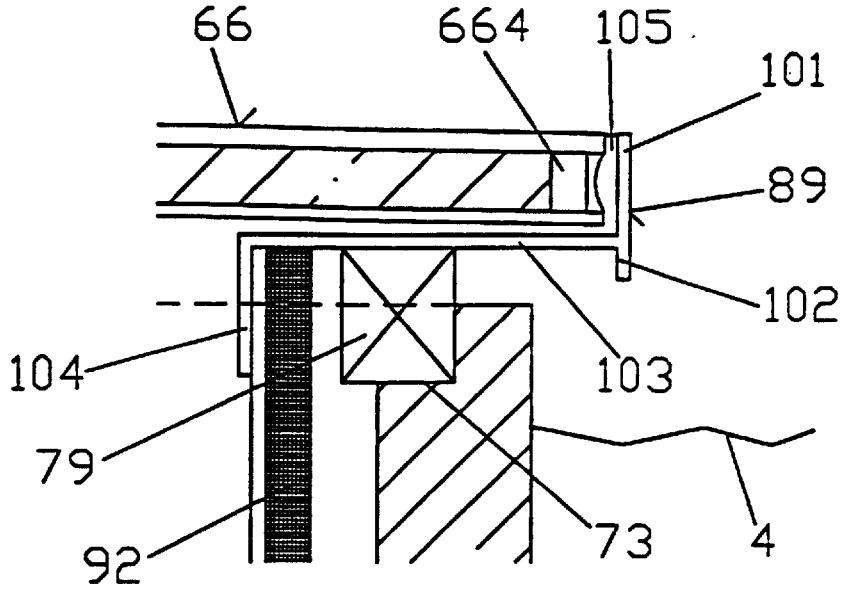
FIG. 10 shows, on an enlarged scale, a second detail from FIG. 8.

FIGS. 9 and 10 show, on an enlarged scale, two details from FIG. 8. FIG. 9 shows, on an enlarged scale, that detail from FIG. 8 which comprises the left-hand border part 663 of the covering panel 66. Said panel border part 663 is assigned a first sealing element 175, which has a profile made up of two "Ls". The first upper L-part comprises legs 1751 and 1752 and the second L-part comprises legs 1753 and 1754. The first L-half 1751 and 1752 corresponds to the L-profile 75 from FIG. 7, and it is also arranged in the same way. The horizontal leg 1751 of this first L-half, however, is designed to be short enough for said leg 1751 still to terminate in front of the end surface of said cover border 663. Said end of the horizontal leg 1751 is adjoined by the top end of the vertical leg 1754, and said leg 1754 is assigned to the end surface of said cover border 663. The horizontal leg 1753 of said second seal half is assigned to the underside of said cover border 663.

Also arranged in this region of the present installation is a further sealing element 88 which has a Z-shaped cross section. The horizontally arranged leg 881 of said Z-profile 8 is located between the horizontal leg 1753 of the double-L profile 175 and the top border 912 of the reflector 91. The bottom vertical leg 882 of the Z-element 88 butts against the inside of the reflector 91. The top vertical leg 883 of the Z-element 88 is assigned to the rear side or inside of the vertical leg 1754 of the double-L element 175.

FIG. 10 shows, on an enlarged scale, that detail from FIG. 8 which comprises the right-hand border part 664 of the covering panel 66. Said panel border part 664 is assigned a sealing element 89, which has a tau-shaped cross section. On account of the similarity between the tau and T, certain constituent parts of the tau shape are referred to in the same way as the corresponding constituent parts of the sealing element 100 with the T-shaped cross section (FIG. 7). The free end part of the stem part 103 is adjoined by a further leg or a strip 104 which is located perpendicularly to the stem part 103 and runs parallel to the bottom vertical leg 102.

The top vertical leg 101 of the tau seal 89 is assigned to the end surface of said border part 664 of the covering panel 66. The joint between these may be filled with a suitable sealing compound 105. The panel border part 664 is located on the horizontally running stem part 103 of the tau seal 89. The tau leg 104 of said sealing element 89 butts against the inside of the reflector 92 arranged here. The second T-leg 102 may serve as a drip-off edge.

The present installation allows underground rooms to be illuminated by daylight in a straightforward and energy-saving manner. No moving parts means that there is barely any wear. Depending on the embodiment, the maintenance outlay is very low to negligible. It is also conceivable for poor light conditions, e.g. in the case of heavy cloud cover or in half-light, for the lighting by daylight to be mixed with, or assisted by, an artificial light source in the shaft 2.

It goes without saying that it is also possible for the features which are disclosed in the description and in the patent claims in conjunction with the individual embodiments to be combined with one another, in order to achieve the set object, in some other way than described above. For example, in the case of the installation according to FIGS. 8 to 10, it is possible for the covering panel 66 to be arranged at a slant, as in the case of the submission according to FIG. 1 or 6, etc.

What is claimed is:

1. An installation for illuminating rooms, in particular in buildings, wherein there is provided a housing (3) which is assigned to one wall (5) of the room (42) which is to be lit;

wherein one of end parts (38) of said housing (3) is located in a region of ground level;

wherein a light-reflecting or light-conducting arrangement is provided in the housing (3) and is designed such that it can guide the light from an outer end part (38) of the housing (3) into the room (42) which is to be lit;

wherein the wall (5) of the room (42) which is to he illuminated has an opening (8), wherein a light-guiding arrangement (10, 30, 50, 80) comprises a first or outer section (11, 31, 51) which extends between the outer end part (38) of the housing (3) and a region of the wall opening (8);

the light-guiding arrangement (10, 30, 50, 80) further having a second or bottom section (12, 32, 52, 82) which is placed in the region of the wall opening (8), the second arrangement section (12, 32, 52, 82) being located beneath and adjoining the first arrangement section (11, 31, 51), and the light-guiding arrangement (10, 30, 50, 80) also having a concave reflector (12, 20, 32, 60, 88) located opposite the wall opening (8).

2. The installation according to claim 1, wherein the first or outer section (11, 31, 51) of the light-guiding arrangement (10, 30, 50, 80) is designed as an interior surface of a substantially vertically arranged cuboid, which is arranged in a top outer region of the housing (3).

3. The installation according to claim 1, wherein the concave reflector (20) of a second or inner section (12) of the light-guiding arrangement (10) is designed as a section of a lateral surface of a cylinder, wherein the longitudinal axis of said cylinder runs horizontally and parallel to the wall (5) of the room (42), wherein said concave reflector (20) is arranged such that the light received from the first arrangement section (11) can be deflected into the room (42) which is to be lit, and wherein a sector angle of said cylindrical wall section (20) may be 90 degrees or less than 90 degrees.

4. The installation according to claim 1, wherein the light-guiding arrangement (30, 50, 80) is designed as a light-guiding channel which is approximately L-shaped, wherein a free end part of a top L-leg of the light-guiding channel is assigned to a top mouth opening (38) of the housing (3) and wherein a free end part of the bottom L-leg of the channel is assigned to the wall opening (8).

5. The installation according to claim 4, wherein an angle gamma between legs (18, 31, and 51, 52) of the light-guiding channel (30, 50) is greater than 90 degrees, wherein a longitudinal axis of the outer channel section (31, 51) runs obliquely in relation to a vertical, wherein a longitudinal axis of the inner channel section (18, 52) runs perpendicularly in relation to the vertical, wherein of the outer channel section (31, 51) comprises a remote reflector (92) opposing the opening (8) in the wall (5), the reflector being placed remote from the wall (5), wherein a concave or bridging or bottom reflector (35, 60) extends between lateral reflectors (93, 94) or the light-guiding channel (30, 50) and is placed between the legs (18, 31, 51, 52) of the light-guiding channel.

6. The installation according to claim 5, wherein the concave reflector (32) is placed between a bottom edge (921) of a remote reflector (92) in the outer channel section (31) and an outer edge (351) of the opening (8) in the wall (5).

7. The installation according to claim 5, wherein an inner section (52) of the light-guiding channel (50) comprises a reflector (54) placed in the bottom region of the opening (8) in the wall (5) and wherein the concave reflector (60) is placed between the bottom edge (921) of the remote reflector (92) in the outer channel section (51) and the outer edge (541) of said bottom reflector (54) in the opening (8).

8. The installation according to claim 4, wherein the angle gamma between the legs (11, 82) of the light-guiding channel (80) is 90 degrees and wherein the concave reflector (88) is arranged in a region of transition between said L-legs (11, 82) and is designed such that light supplied through the first L-leg (11) can be deflected into the second L-leg (82).

9. The installation according to claim 8, wherein the concave reflector (88) is made up of planar panels (86, 87), positions of which are at different angles to a horizontal.

10. The installation according to claim 8, wherein the concave reflector (88) extends between lateral reflectors (83) of the channel (80), wherein said concave reflector (88) has two sections (86, 87) which are arranged one behind the other, wherein the two sections (86, 87) may be a same length, wherein the angular positions of the two sections (86, 87) in relation to a horizontal area are different, wherein an outer edge of a first of the two sections (86) adjoins an outer edge (851) of the bottom reflector (85) of the interior leg (82) of the channel (80) in the opening (8), wherein an outer edge of the second section (87) adjoins the bottom edge (921) of the second reflector (92) in the first leg (11) of the channel (80).

11. The installation according to claim 10, wherein the first reflector section (86) encloses an angle of approximately 20 degrees with the horizontal and the second reflector section (87) encloses an angle of approximately 60 degrees with the horizontal.

12. The installation according to claim 1, wherein an arrangement for ventilating the room which is to be lit is provided in addition to the light-guiding arrangement (10, 30, 50, 80), wherein a window (1) is arranged at the opening (8) in the wall of the room (42) which is to be lit, and wherein said window (1) is designed such that it allows not only the incidence of light into the room (42) but also ventilation of said room (42) in the building (5).

13. The installation according to claim 1, wherein an outer mouth opening (38) of the light-guiding arrangement (10, 30, 50, 80) is covered over with a sheet-like arrangement (25, 27, 41, 66) which is designed such light enters into the light-guiding arrangement (10, 30, 50, 80) and prevents water from penetrating into the light-guiding arrangement (10, 30, 50, 80) and that said sheet-like arrangement (25, 27, 41, 66) is further designed such that it allows air to flow between the interior (42) and the outside of the building.

14. The installation according to claim 13, wherein a grating (68) is located in the top mouth opening of the secondary channel (24) in the housing (3) of the installation and wherein the grating (68) covers over said mouth opening, but allows air to flow through said mouth opening of the housing (3).

15. The installation according to claim 13, wherein the arrangement (25, 27, 41, 66) is provided horizontally or sloping down away from the wall (5).

16. The installation according to claim 15, wherein the sheet-like arrangement (25, 27, 41, 66) slopes down at an angle of from 10 to 45 degrees to the horizontal.

17. The installation according to claim 12, wherein the outer channel section (11) has at least two mutually opposite sheet-like reflector elements (91, 92) which run parallel to the wall (5) and to a transverse wall (6) of the housing (3), wherein a first of the reflector elements is assigned to the wall (5) above the building opening (8), wherein a second of the reflector elements (92) is assigned to the inside of the transverse wall (6) of the housing (3), wherein the top edge (912) of said first reflector plate (91) is located above the top edges (37) of the side walls (71, 72) of the housing (3), wherein the top edge (922) of the second reflector plate (92) is likewise located above the top edges (37)of the side walls (71, 72) of the housing 93) but beneath said top edge (912) of the first reflector panel (91) and wherein the covering arrangement (41) rests on the top edges (912, 922) of the reflector panels (91, 92) placed parallel to the wall (5).

* * * * *